US008631958B2

(12) United States Patent
An

(10) Patent No.: US 8,631,958 B2
(45) Date of Patent: Jan. 21, 2014

(54) INTERNAL GAS PRESSURE RESISTANT METAL POP-TOP COVER AND METHOD OF MAKING

(75) Inventor: Shu An, Suzhou (CN)

(73) Assignee: Suzhou Slac Precision Equipment Inc. (CN)

( * ) Notice: Subject to any disclaimer, the term of this patent is extended or adjusted under 35 U.S.C. 154(b) by 782 days.

(21) Appl. No.: 12/302,360

(22) PCT Filed: Apr. 25, 2007

(86) PCT No.: PCT/CN2007/001378

§ 371 (c)(1),
(2), (4) Date: Nov. 25, 2008

(87) PCT Pub. No.: WO2007/137480

PCT Pub. Date: Dec. 6, 2007

(65) Prior Publication Data

US 2010/0059517 A1 Mar. 11, 2010

(30) Foreign Application Priority Data

May 27, 2006 (CN) ..... 2006 1 0085892

(51) Int. Cl.
*B65D 17/34* (2006.01)

(52) U.S. Cl.
USPC ..... 220/269

(58) Field of Classification Search
USPC ..... 220/269, 906
See application file for complete search history.

(56) References Cited

U.S. PATENT DOCUMENTS 3,422,984 A * 1/1969 Foster ..... 220/269
3,979,009 A * 9/1976 Walker ..... 220/609
4,580,692 A * 4/1986 La Barge et al. ..... 220/240
5,069,372 A * 12/1991 Kawajiri et al. ..... 222/541.9
5,357,667 A * 10/1994 Schutz ..... 29/509

(Continued)

FOREIGN PATENT DOCUMENTS

CN 2045371 U 10/1989
CN 2425027 Y 3/2001

(Continued)

OTHER PUBLICATIONS

International Search Report of PCT/CN2007/001378 dated Aug. 9, 2007.

*Primary Examiner* — Steven A. Reynolds
*Assistant Examiner* — King M Chu
(74) *Attorney, Agent, or Firm* — Cantor Colburn LLP

(57) ABSTRACT

A gas pressure-resistant metal pop-top cover comprised of two parts, a lid (1) and a pull-ring, the pull-ring being riveted to the lid (1), there being a concave countersink that begins at the circumferential edge of the lid (1) and extends toward its center, and at the center of the concave countersink there being a round convex platform (2), wherein the angle of inclination A of the countersink is 15-60°, and the arc-shaped segments B1 and B2 of the bottom part of the convex platform and the corner portion of the rise segment C rotate around the center of the lid (1) and are subjected to cold hardening treatment through forging and pressing. Through a new design, the conflict between material-saving and maintaining pressure resistance in a pop-top cover has been solved, with the result that greater resistance to high pressure is provided as the notch diameter and thickness of materials in the pop-top cover are decreased.

21 Claims, 4 Drawing Sheets

(56) References Cited

U.S. PATENT DOCUMENTS

| | | | | |
|---|---|---|---|---|
| 5,750,222 | A * | 5/1998 | Komatsu et al. | 428/35.8 |
| 5,987,956 | A * | 11/1999 | Strube et al. | 72/348 |
| 6,065,634 | A * | 5/2000 | Brifcani et al. | 220/619 |
| 6,206,222 | B1 * | 3/2001 | Cudzik | 220/258.3 |
| 6,223,931 | B1 * | 5/2001 | Strube et al. | 220/609 |
| 6,419,110 | B1 | 7/2002 | Stodd | |
| 6,516,968 | B2 | 2/2003 | Stodd | |
| 7,341,163 | B2 | 3/2008 | Stodd | |
| 8,186,532 | B2 * | 5/2012 | Shinguryo et al. | 220/269 |
| 2003/0121924 | A1 | 7/2003 | Stodd | |
| 2004/0206764 | A1 * | 10/2004 | Gardiner | 220/733 |
| 2005/0029269 | A1 | 2/2005 | Stodd et al. | |
| 2007/0007294 | A1 * | 1/2007 | Jentzsch et al. | 220/619 |
| 2007/0261980 | A1 * | 11/2007 | Cox et al. | 206/438 |

FOREIGN PATENT DOCUMENTS

| | | | |
|---|---|---|---|
| CN | 2640932 | Y | 9/2004 |
| EP | 0158711 | A | 10/1985 |
| JP | 4-352641 | A | 12/1992 |
| JP | 7-52947 | A | 2/1995 |
| JP | 2002-145263 | A | 5/2002 |

* cited by examiner

INTERNAL GAS PRESSURE RESISTANT METAL POP-TOP COVER AND METHOD OF MAKING

RELATED APPLICATIONS

This patent application claims priority to International Patent Application No. WO 2007/137480 A1 filed Apr. 25, 2007 which claims priority to CN Application No. 200610085892.5 filed May 27, 2006, all of which are incorporated herein by reference in their entirety.

TECHNICAL FIELD

The present invention relates to pop-top covers for food product and beverage cans; in particular, it relates to savings on materials and to a gas pressure-resistant metal pop-top cover.

BACKGROUND ART

With the continuing increase in the living standards of the people, there is also an increasing demand on the market for foods and beverages, and the production of food and beverage cans has been growing each year. Severe competition in the metal packaging industry for food and beverages has arisen in this tide of economic development. For this reason, in order to conserve natural resources, lower costs and meet the demands of market competition, research on the saving of materials and the development of gas pressure-resistant metal pop-top covers is not only a necessity for the survival and development of the industry, but it is also essential for the economic development of the market.

At present, most of the metal beverage containers on the market make use of gas pressure-resistant metal pop-top covers that have small openings. This type of pop-top cover is general comprised of two components, a lid and a pull-ring. The pull-ring is riveted to the lid. However, in order for the pop-top to have the characteristic of gas pressure-resistance, the main body of the lid, which begins at the lid's circumferential edge and extends toward the center, is designed with a concave countersink structure. When beverage cans that use metal pop-top covers are subjected to increased internal pressure (for example, because of temperature increase), the lid may become unstable and slip, with the result that the internal volume of the can is increased in order to prevent danger from arising due to excessive internal pressure. For a long time, in order to maintain high pressure resistance strength on the part of the lid in the face of buckling due to destabilization, the countersink inclination has been designed to be comparatively small, with a course of inclination of 1-14° as shown, for example, by angle A in FIG. 1. However, as the demand for savings on materials continually increases, the question of how to continually decrease the notch diameter of the material and its thickness has become a very important topic.

DISCLOSURE OF THE INVENTION

The present invention provides an gas pressure-resistant metal pop-top cover that is designed to resolve the conflict between material savings and the maintenance of pressure resistance in a pop-top cover so that the pop-top cover still provides relatively high gas pressure resistance while the material's notch diameter and thickness are decreased.

The technological plan described below is used to achieve these objectives in this invention. The invention relates to an gas pressure-resistant metal pop-top cover comprised of two parts, a lid and a pull-ring, with the pull-ring being riveted to the lid, there being a concave countersink that begins at the circumferential edge of the lid and extends toward its center, and there being at the center of the concave countersink a round convex platform, wherein the angle of inclination A of the countersink is 15-60°, and the arc-shaped segments B1 and B2 of the convex platform and the corner portion of the rise segment C rotate around the center of the lid and are subjected to cold hardening treatment through forging and pressing.

An explanation of the relevant content of the above-described technological plan is as follows:

1. In the foregoing plan, in order to further increase pressure resistance, the convex platform can be designed as a two-stage convex platform structure, that is, a two-stage stepped-rise convex platform structure.

2. In the foregoing program, it is preferable for the angle of inclination A of the countersink to be 15-45°.

3. The principle of this invention is: Increasing the angle A in a cover of the same type in a range of 15-60 degrees enables the material notch diameter of the pop-top cover to be increased, the utilization ratio of the pop-top cover to be increased, and a savings to be realized in the production cost of the pop-top cover. However, this may decrease pressure-resistance strength. In order further to maintain pressure resistance after increasing angle A, in the present plan, local cooling and hardening treatment of the bottom segment B of the lid and segment C of the intermediate rise is performed at the same time through forging and pressing; that is, the arc-shaped segments B1 and B2 and the rise segment C in FIG. 2 that rotate around the center of the lid are subjected to local central forging and pressing, which causes an increase in pressure resistance due to local micro-deformation and processing hardening, enabling the objectives of the plan to be realized.

Because of the use of the above-described technological program, the present invention has the following advantages as compared to existing technology:

1. Under the premise that pressure resistance is maintained, this invention reduces the diameter of the material notch and further saves on lid materials. In mass production of pop-top covers, this is highly significant because it has a marked effect in economizing on materials.

2. The use of this invention increases the utilization ratio of metal materials in pop-top covers in actual production, which directly reduces production costs.

3. Provided there are no changes in the material used, this invention can effectively increase the pressure resistance characteristics of pop-top covers.

In the foregoing figures: 1, lid; 2, convex platform; 3. two-stage convex platform.

EMBODIMENTS

We shall now present further descriptions of this invention together with figures and working examples.

Working Example 1

Figure 1:
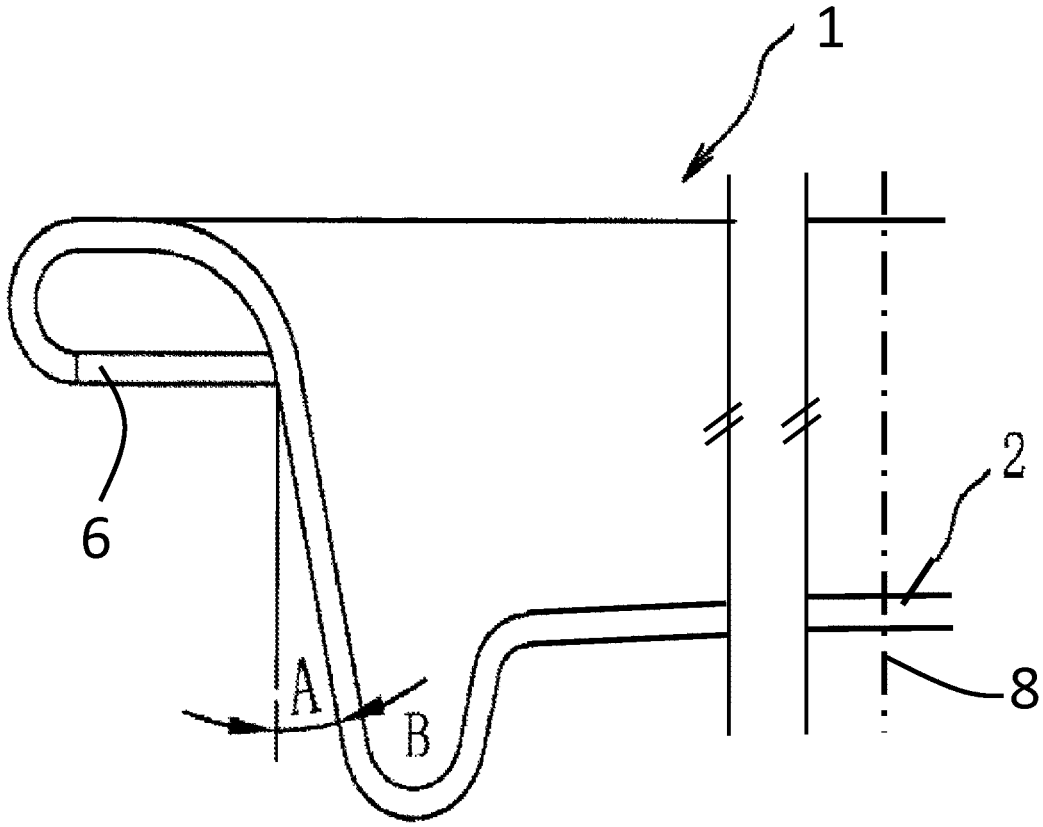
FIG. 1 is a partial schematic sectional view of the pop-top cover of this invention (not pressed for cold hardening indentation)
Figure 2:
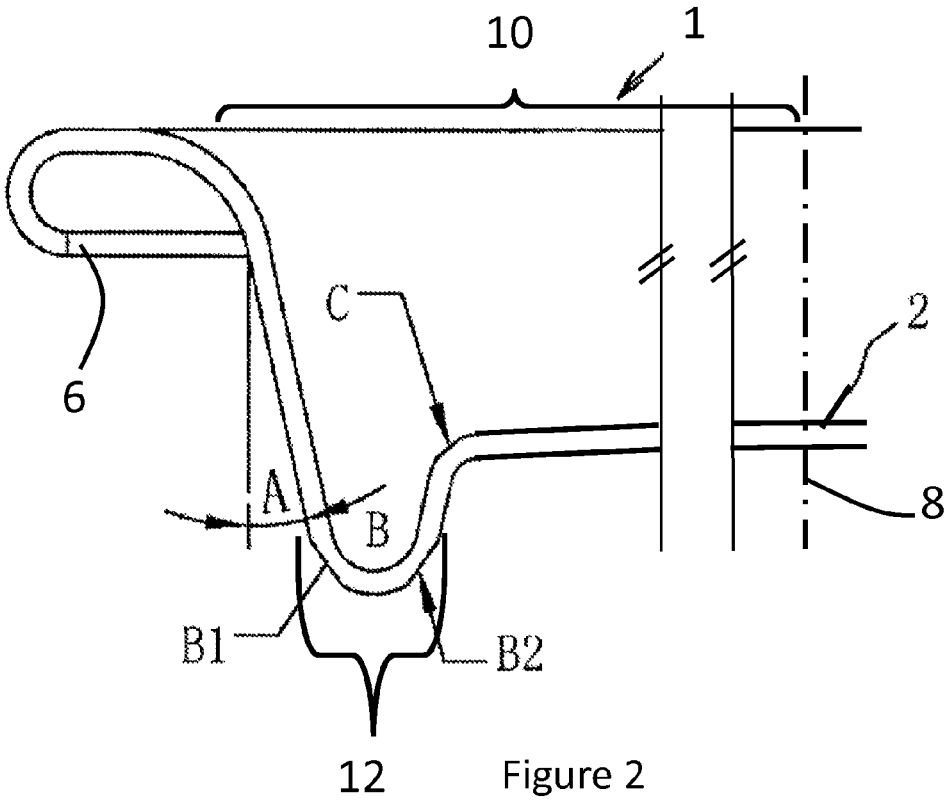
FIG. 2 is a partial schematic sectional view of the pop-top cover of this invention (pressed for cold hardening indentation)

As shown in FIG. 1 and FIG. 2, a gas pressure-resistant metal pop-top cover is constructed of two parts, the lid 1 and a pull-ring. The pull-ring is riveted onto the lid 1, and a concave countersink 10 is established in the lid 1, beginning at its circumferential edge 6 and extending toward its center 8. The center of the concave countersink 10 is in the circular convex platform 2, the angle of inclination A of the countersink is in the range of 15-45°, and the arc-shaped segments B1 and B2 in the bottom part 12 of the convex platform and the corner portion of the rise segment C that rotate or are disposed around the center of the lid are subjected to cold hardening treatment through forging and pressing.

The pop-top cover is completed by a major two-step production technology (the two large steps being categories of cold processing). The first step is to produce the base lid. Specifically, a coil material or a sheet material is fed in and the base lid is formed at one time by punch pressing and impact extrusion. In the process of forming by impact extrusion, the metal will inevitably be fluid. Each formed step should be a circular arc. This is convenient for metal flow, but cannot result in the occurrence of sites that are easily broken, such as sharp corners. The second step is to form the base cover into the pop-up cover. (In general, research has been limited to how to carry out processing of a perfect pop-up shape on the lid, for example, to the principles of four-step forming and pull-ring forming.) In the process of multiple work station pop-top cover forming, one or several work stations can be added or changed to form the base lid by impact extrusion (see FIGS. 1 and 2), that is, by producing plastic deformation at the key site and then locally changing the stress value. (When metal materials are subjected to plastic deformation below the recrystallization temperature, strength and hardness are increased. Decreasing plasticity and toughness is also referred to as cold hardening. This occurs because, when a metal is undergoing plastic deformation, the grain slips and entwining of dislocations appears, which in turn causes elongation, breaking and fibrosis of the grain and produces residual stress within the metal.) An important index of gas pressure-resistant pop-top covers is the capacity to maintain the greatest possible high pressure resistance without the occurrence of buckling due to destabilization.

Figure 4:
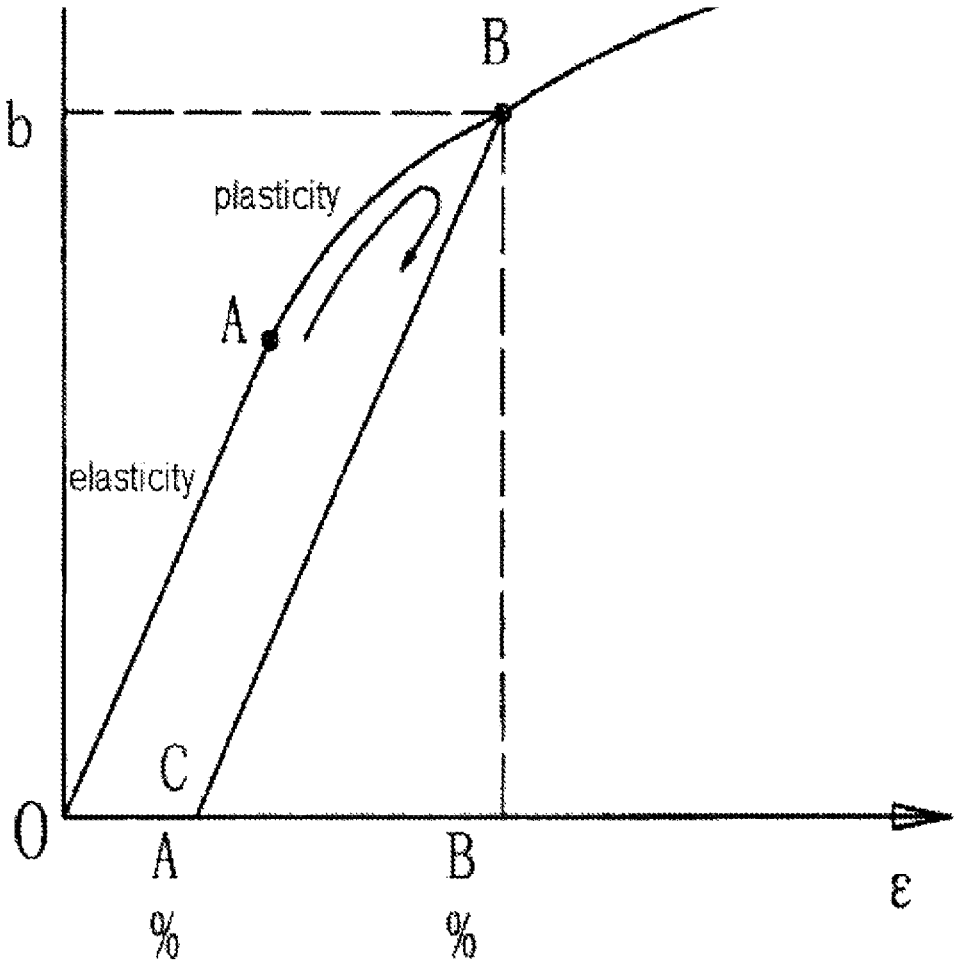
FIG. 4 is a stress-strain diagram (1)
Figure 5:
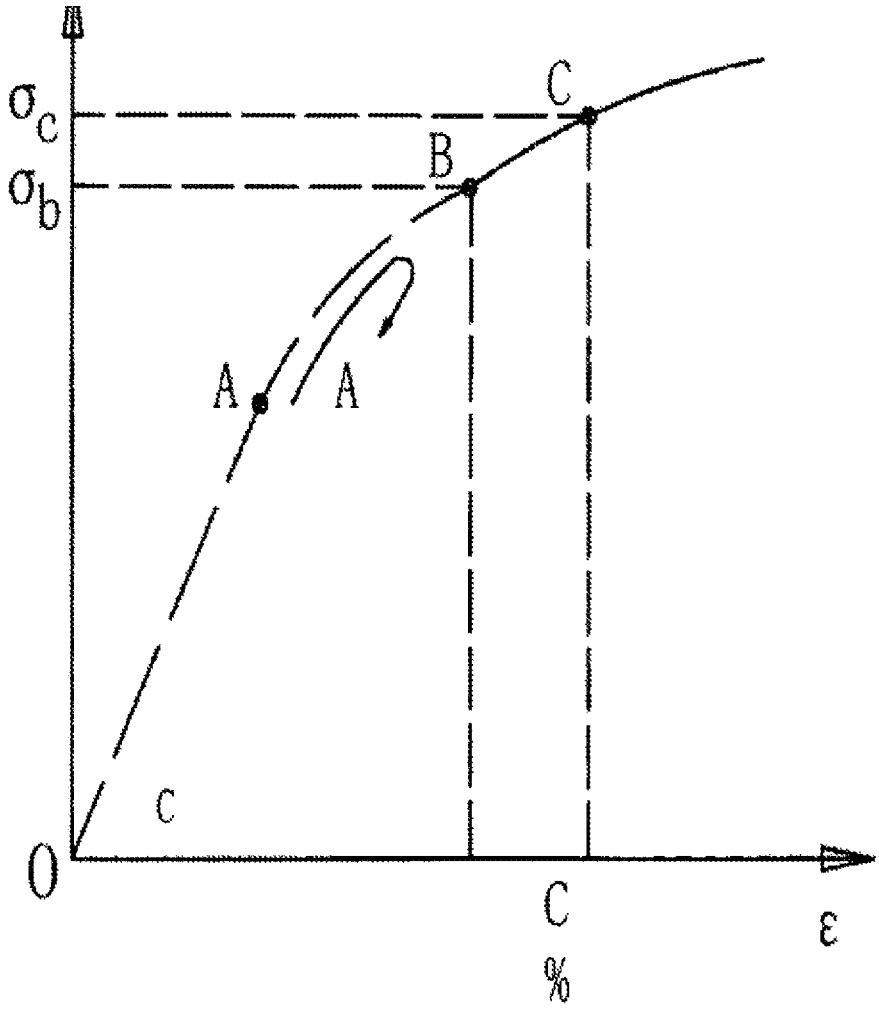
FIG. 5 is a stress-strain diagram (2)

We can also explain these changes in terms of material mechanics. The tensile curve (the stress-strain diagram as shown in FIG. 4) is a classical concept in materials mechanics. Using this concept, we can effectively improve a material's properties of pressure resistance and buckling under destabilization. Let us assume that buckling due to destabilization occurs in a certain key corner site in the cover and that press transformation at this site has reached $\epsilon$=B %; in other words, let us assume that this cover has not undergone plastic deformation. The cover's buckling due to destabilization will increase as pressure (stress) increases. If a region has undergone elastic deformation but the amount of deformation (strain) is B %, destabilization occurs and the stress at this time is $\delta_b$. If we subject this region to a fixed degree of plastic deformation and later allow it to recover, the change in the stress-strain diagram for this region (as shown in FIG. 5) will be as follows: If the region is again subjected to stress, [the stress] will begin with residual strain EA, and, similarly, if an amount of strain of B % is caused to occur in this region, the corresponding stress zone will range from 0 to $\delta_c$, which is greater than the previous $\delta_b$.

Working Example 2

Figure 3:
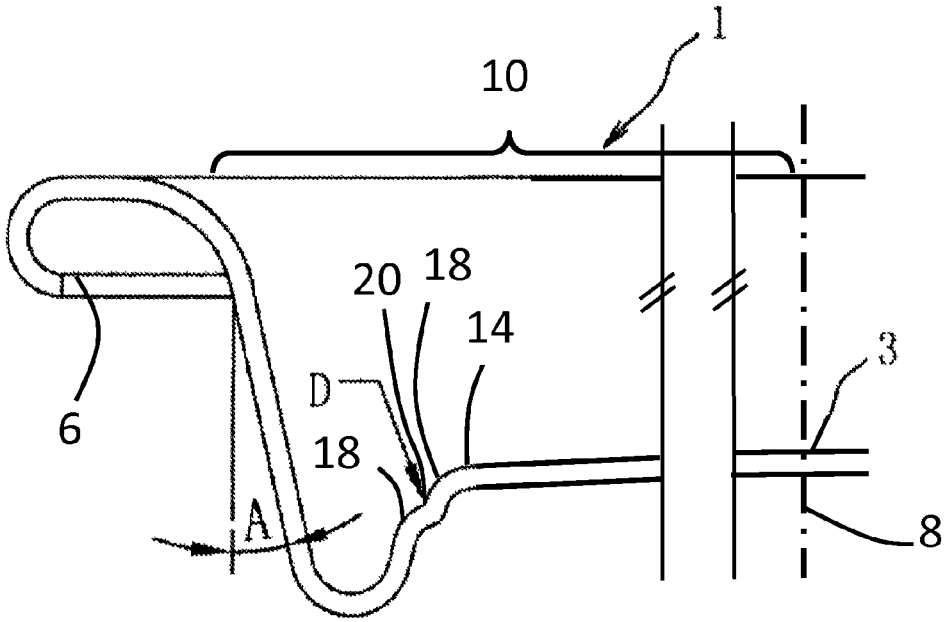
FIG. 3 is a partial schematic sectional view of the pop-top cover of this invention having another type of structure (two-stage convex platform).

As shown by reference to FIG. 1 and FIG. 3, a gas pressure-resistant metal pop-top cover is constructed of two parts, the lid 1 and a pull-ring. The differences from Working Example 1 are as follows: The convex platform is a two-step (D) rising convex platform structure. That is, it is the two-step (D) rising convex platform 3 in the upper surface 14 of the cover and lid 1 as shown in FIG. 3. The two-stage convex platform comprises two rising steps 18 in the upper surface 14 of the cover defined by an indentation 20 in the upper surface between the steps. The other factors are the same as in Working Example 1 and will not be described again here. As can be seen from FIG. 3, deformation and processing hardness could be achieved and the pressure resistance of the pop-top cover could be further increased using an embodiment in which the convex platform was the two-step (D) rising convex platform 3.

The above-described working examples are intended to describe the technological concepts and characteristics of this invention, the objective being to allow those familiar with this technology to understand the content of this invention and to implement it on this basis. However, the scope of protection of this invention should not be construed as limited to the particular forms disclosed. Any equivalent changes and modifications made in accordance with the spirit and essence of this invention should be within the scope of protection of this invention.

The invention claimed is:

1. A gas pressure resistant metal pop-top cover, comprising:

a metal lid comprising a circumferential edge, a center, a concave countersink extending from the circumferential edge toward the center and a circular convex platform located within the concave countersink, the concave countersink having a bottom part that is disposed around the center of the lid, the bottom part having a plastically deformed and cold hardened segment having an amount of plastic deformation and a hardness that is greater than adjacent portions of the lid, the convex platform is a two-stage platform comprising two rising steps in an upper surface of the cover defined by an indentation in the upper surface between the steps.

2. The gas pressure resistant metal pop-top cover as described in claim 1, wherein an angle of inclination of the countersink is 15-60°.

3. The gas pressure resistant metal pop-top cover as described in claim 2, wherein the angle of inclination of the countersink is 15-45°.

4. The gas pressure resistant metal pop-top cover as described in claim 1, wherein the bottom part comprises an upwardly concave curved portion of the lid at the base of the concave countersink.

5. The gas pressure resistant metal pop-top cover as described in claim 4, wherein the curved portion of the bottom part is plastically deformed and cold hardened in an arc-shaped segment thereof.

6. The gas pressure resistant metal pop-top cover as described in claim 4, wherein the curved portion of the bottom part is plastically deformed and cold hardened in a plurality of arc-shaped segments thereof.

7. The gas pressure resistant metal pop-top cover as described in claim 6, wherein the curved portion of the bottom part is plastically deformed and cold hardened in two arc-shaped segments thereof, and the respective arc-shaped segments are generally opposite one another along the curved portion of the bottom part.

8. The gas pressure resistant metal pop-top cover as described in claim 1, wherein the convex platform comprising two rising steps in an upper surface of the cover defined by an indentation in the upper surface between the steps comprises a plastically deformed and cold hardened segment having an amount of plastic deformation and a hardness that is greater than adjacent portions of the lid.

9. The gas pressure resistant metal pop-top cover as described in claim 8, wherein the plastically deformed and cold hardened segment of the two rising steps is plastically deformed and cold hardened in an arc-shaped segment thereof.

10. A gas pressure resistant metal pop-top cover, comprising:

a metal lid comprising a circumferential edge, a center, a concave countersink extending from the circumferential edge toward the center and having an angle of inclination of 15-60° and a plastically deformed, cold hardened, circular two-stage convex platform located within the concave countersink, the concave countersink having a bottom part that adjoins the concave countersink, the two-stage convex platform comprising two rising steps in an upper surface of the cover defined by an indentation in the upper surface between the steps.

11. The gas pressure resistant metal pop-top cover as described in claim 10, wherein the convex platform comprising two rising steps in an upper surface of the cover defined by an indentation in the upper surface between the steps comprises a plastically deformed and cold hardened segment having an amount of plastic deformation and a hardness that is greater than adjacent portions of the lid.

12. The gas pressure resistant metal pop-top cover as described in claim 11, wherein the plastically deformed and cold hardened segment of the two rising steps is plastically deformed and cold hardened in an arc-shaped segment thereof.

13. The gas pressure resistant metal pop-top cover as described in claim 10, wherein the two rising steps are plastically deformed and cold hardened to a greater extent than other portions of the lid.

14. The gas pressure resistant metal pop-top cover as described in claim 10, wherein the bottom part comprises an upwardly concave curved portion of the lid at the base of the concave countersink.

15. The gas pressure resistant metal pop-top cover as described in claim 14, wherein the curved portion of the bottom part is plastically deformed and cold hardened in a plurality of arc-shaped segments thereof.

16. The gas pressure resistant metal pop-top cover as described in claim 15, wherein the curved portion of the bottom part is plastically deformed and cold hardened in two arc-shaped segments thereof, and the respective arc-shaped segments are generally opposite one another along the curved portion of the bottom part.

17. A method of making a gas pressure resistant metal pop-top cover, comprising:

forming a metal lid comprising a circumferential edge, a center, a concave countersink extending from the circumferential edge toward the center and a circular convex platform located within the concave countersink having a bottom part that is disposed around the center of the lid, the bottom part having a plastically deformed and cold hardened segment having an amount of plastic deformation and a hardness that is greater than adjacent portions of the lid, the convex platform is a two-stage platform comprising two rising steps in an upper surface of the cover defined by an indentation in the upper surface between the steps.

18. The method of claim 17, wherein forming the metal lid further comprises:

punch pressing and impact extruding a metal sheet to form the metal lid comprising the circumferential edge, the center, the concave countersink extending from the circumferential edge toward the center and the circular convex platform located within the concave countersink and having the bottom part that is disposed around the center of the lid and the two rising steps in an upper surface of the cover defined by the indentation; and forging and pressing to plastically deform and cold harden the bottom part and provide the plastically deformed and cold hardened segment having an amount of plastic deformation and a hardness that is greater than adjacent portions of the lid.

19. The method of claim 17, wherein forging and pressing further comprises:

deforming the two rising steps to form the plastically deformed and cold hardened segment having an amount of plastic deformation and a hardness that is greater than adjacent portions of the lid.

20. A method of making a gas pressure resistant metal pop-top cover, comprising:

forming a metal lid comprising a circumferential edge, a center, a concave countersink extending from the circumferential edge toward the center and having an angle of inclination of 15-60° and a plastically deformed, cold hardened, circular two-stage convex platform located within the concave countersink, the concave countersink having a bottom part that adjoins the concave countersink, the two-stage convex platform comprising two rising steps in an upper surface of the cover defined by an indentation in the upper surface between the steps.

21. The method of claim 20, wherein forming the metal lid further comprises:

punch pressing and impact extruding a metal sheet to form the metal lid comprising the circumferential edge, the center, the concave countersink extending from the circumferential edge toward the center and the convex platform located within the concave countersink; and forging and pressing to plastically deform and cold harden the circular two-stage convex platform having two rising steps defined by the indentation in the upper surface between the steps.

* * * * *